United States Patent [19]

Broomfield et al.

[11] Patent Number: 4,715,316

[45] Date of Patent: Dec. 29, 1987

[54] APPARATUS FOR PLATING AND COATING

[75] Inventors: Donald J. Broomfield, Elgin, Ill.; Paul C. Briggs, North Andover, Mass.; Eric G. Parker, Algonquin; David P. Wagner, Geneva, both of Ill.

[73] Assignee: Illinois Tool Works Inc., Chicago, Ill.

[21] Appl. No.: 850,517

[22] Filed: Apr. 11, 1986

Related U.S. Application Data

[62] Division of Ser. No. 712,597, Mar. 18, 1985, Pat. No. 4,600,662.

[51] Int. Cl.[4] ..... C23C 16/00

[52] U.S. Cl. ..... 118/716; 118/50; 118/423; 118/719; 118/730; 204/192.31; 204/298

[58] Field of Search ..... 427/38; 118/716, 719, 118/730, 50, 423; 204/192.31, 298

[56] References Cited

U.S. PATENT DOCUMENTS 4,085,248 4/1978 Zehender et al. ..... 427/38

*Primary Examiner*—Bernard D. Pianalto

*Attorney, Agent, or Firm*—David I. Roche; Thomas W. Buckman

[57] ABSTRACT

Method and apparatus for the coating of a substrate wherein the following chronologically takes place under vacuum conditions: (i) non-oxidized plating material is deposited on the substrate via ion vapor deposition; and (ii) a coating material is chemically bonded with the non-oxidized plating material. The coating material may comprise a primer, which chemically bonds with the non-oxidized plating material, and a polymer, which impregnates the primer-prepared plating material. Said polymer may also chemically bond with the primer. Alternatively, the coating material may comprise an epoxy which forms an organo-metallic bond with the plating material. In another embodiment of the invention, the coating material may comprise boron trifluoride, which chemically bonds with the non-oxidized plating material, and a polymer, which impregnates the boron trifluoride-prepared plating material. Alternatively, the coating material may comprise calcium, silicon, and oxygen which chemically bonds with the plating material. The coating material may be bifunctional, in that it not only chemically bonds with the plating material but also bonds with a second coating material, yielding a chemically bonded uniform coating with desired results.

5 Claims, 10 Drawing Figures

11
12
13
14
14
16
13
31
15
21
35
37
22
39
41
23
32
43
24
45
END PRODUCT 12a
11a
13a
14a
16a
41a
15a
32a
23a
43a
22a
39a
24a
45a
END PRODUCT 12b
11b
13b
14b
16b
41b
15b
32b
23b
43b
22b
39b
END PRODUCT 12c
11c
13c
14c
15c
16c
22c
39c
END PRODUCT 49
12d
53
11d
52
13d
14d
15d
16d
END PRODUCT

APPARATUS FOR PLATING AND COATING

This is a division, of application Ser. No. 712,597, filed Mar. 18, 1985, now U.S. Pat. No. 4,600,662.

BACKGROUND OF THE INVENTION

The present invention relates to a novel method and apparatus for coating plated articles or substrates and to novel articles produced thereby.

One method which has been used for depositing plating material on various articles or substrates is ion vapor deposition which is a vacuum vapor plating process. For example, reference is made to U.S. Pat. No. 4,116,161 which discloses background information concerning ion vapor deposition systems and describes one specific method and apparatus for carrying out the process. The plating material is usually applied to the substrate in order to protect the substrate from its environment and/or to give the substrate an enhanced appearance. For example, aluminum is frequently used to provide a durable and attractive coating for various steel or ferrous metal products.

Although plating material can be deposited as a substantially continuous layer on the substrate via ion vapor deposition, typically, many voids in the plating material do exist. Problems can be encountered in the event electrolyte enters the voids in the plating material since in many environments, the presence of such an electrolyte promotes corrosion. Galvanic corrosion is especially a problem when metals of different electrical potentials such as ferrous metals and aluminum are in contact with each other in the presence of an electrolyte.

It is a primary object of the present invention to provide a novel method and apparatus for coating such plated articles and filling the voids in the plating material in a manner which insures a good bond between the coating and the plating material for minimizing any possibility of galvanic corrosion.

It is a further object of the present invention to provide a novel method in apparatus of the above-described type which is capable of producing novel plated and coated articles in an efficient and economical manner.

When plating materials such as aluminum are applied to a substrate in accordance with prior procedures, the surface of the aluminum plating quickly becomes oxidized upon completion of the plating process and exposed to the atmosphere. The presence of such an aluminum oxide layer at the surface of the aluminum plating material inhibits chemical reaction of the pure metal with various coating materials. Therefore it is a further object of the present invention to provide a novel method and apparatus of the above-described type whereby articles plated with aluminum and the like may subsequently be coated without interference from oxides which previously existed on the surface of the plating material.

SUMMARY OF THE INVENTION

It has been discovered that an effective coating can be obtained on a plated substrate by applying and chemically bonding the coating material to the plated surface while preventing oxidation of the plated surface by contact with air or otherwise. A "chemical bonding application" can be carried out by initially using ion vapor deposition means to deposit a non-oxidized plating material on a substrate. Ion vapor deposition is performed in a inert gas atmosphere under a vacuum. By maintaining the inert atmosphere and vacuum after ion vapor deposition, the non-oxidized plating material will not be able to oxidize and will be highly reactive for chemical bonding with coating material. Then the coating material can be applied preferably under a vacuum, and chemically bonded to the plating material.

In one embodiment, the coating material may comprise a primer and a polymer. Once the plating material has been deposited on a substrate via ion vapor deposition, the coating application can proceed by applying the primer under an inert atmosphere to chemically bond with the non-oxidized plating material. Then any excess primer is preferably removed by vacuum washing and/or vacuum drying means. Vacuum impregnation is used to impregnate the primer-prepared plating material with a polymer. The polymer is then subjected to chemical and/or ultraviolet curing.

In another embodiment, the coating material may comprise an epoxy. After the plating material has been deposited on a substrate via ion vapor deposition, the epoxy is applied under an inert atmosphere to chemically bond with the non-oxidized plating material. The excess epoxy is preferably removed by vacuum spin means. The epoxy is then subjected to chemical or ultraviolet curing.

An alternative coating application can be carried out using a coating material comprising stearic acid. After ion vapor deposition means are used to deposit the plating material on the substrate, the application can proceed by applying a stearic acid solution under an inert atmosphere to chemically bond with the non-oxidized plating material. The excess stearic acid solution is preferably removed by solvent washing and vacuum drying means.

In another embodiment of the invention, the coating material may comprise boron trifluoride and a polymer. Once the plating material has been deposited on the substrate via ion vapor deposition, the application can proceed by applying boron trifluoride under an inert atmosphere to react chemically with the non-oxidized plating material. Then vacuum impregnation means are used to impregnate the boron trifluoride-prepared plating material with a polymer. Finally, vacuum drying means are used to remove unreacted reagents.

In another embodiment, the coating material may comprise calcium, silicon and oxygen. After the plating material has been deposited on a substrate via ion vapor deposition, the coating application can be carried out by vaporizing calcium and silicon, in a controlled plasma atmosphere containing oxygen, and applying the calcium, silicon and oxygen to chemically bond with the non-oxidized plating material.

Since there is chemical bonding between the plating material and the coating material in all the above said applications, there is less likelihood that an electrolyte can fill voids in the plating material and initiate corrosion.

DETAILED DESCRIPTION OF THE INVENTION

Figure 6:
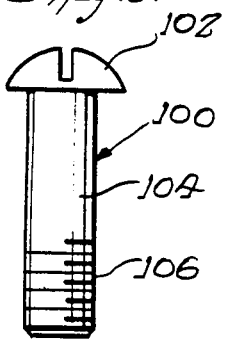
FIG. 6 is a view of a steel screw, plated and coated in accordance with the present invention, the steel screw being shown as representative of a typical substrate.

The present invention contemplates the provision of a wide variety of articles comprising a plated substrate which is effectively coated in order to protect the substrate, the plating material and any parts with which the substrate may be assembled from corrosion. As an example of articles or substrates which may be produced in accordance with the present invention a fastener or screw is shown in FIG. 6. However, it is to be understood that many different articles and substrates may be similarly produced. Furthermore, it is contemplated that the screws or other substrates may be made of oxidizable metals such as ferrous metals or steel while the plating material is to be a metal such as aluminum which quickly oxidizes, at least at its surface, when exposed to the air. The present invention contemplates chemical bonding between the aluminum or other plating material and the coating material. Such a bond is enhanced by preventing the plating material from oxidizing or forming an oxide surface layer prior to the application of the coating material to the article. Therefore, the present invention contemplates that an inert gas atmosphere is to be maintained around the plated articles, at least until the plating material has been coated. A preferred procedure for applying the plating material is to utilize an ion vapor deposition apparatus in which a vacuum or reduced pressure is maintained and also in which an inert gas atmosphere is maintained. Hence, it is contemplated that the remaining portions of the coating application described below will be carried out under the same or similar inert gas atmosphere.

Figures 1, 2:
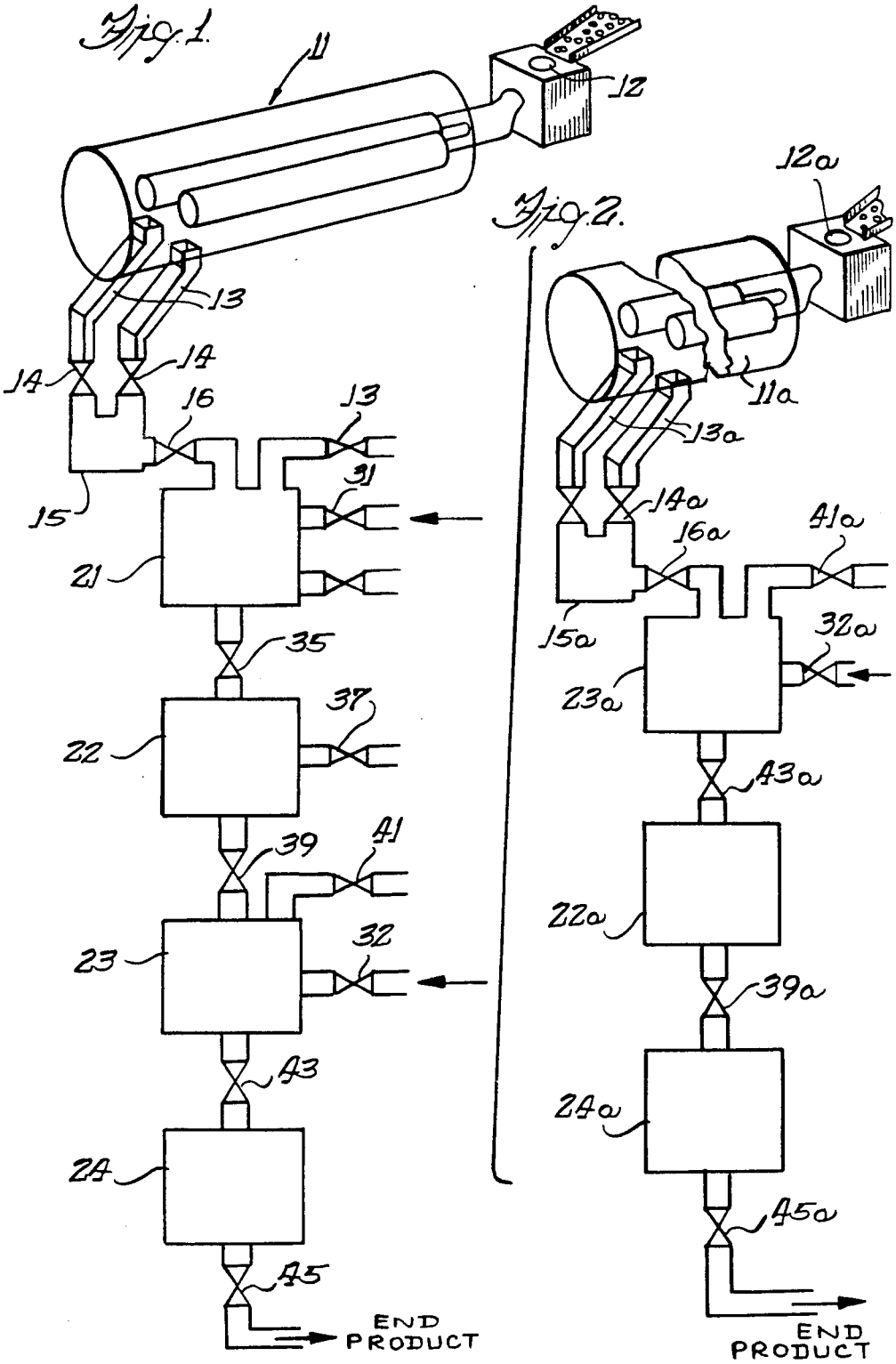
FIG. 1 is a schematic representation of an embodiment of the apparatus of the invention to coat a substrate with non-oxidized plating material, followed by a coating material comprised of a primer and a polymer.
FIG. 2 is a schematic representation of an embodiment of the apparatus of the invention to coat a substrate with non-oxidized plating material, followed by a coating material comprised of an epoxy.

An apparatus incorporating one embodiment of the present invention for coating or plating a substrate with a non-oxidized plating material and subsequently applying a coating material comprising a primer and a polymer is schematically shown in FIG. 1. In this embodiment, the apparatus comprises an ion vapor deposition or plating device 11 of known construction such, for example, as is shown and described in U.S. Pat. No. 4,116,161, the disclosure of which patent is incorporated herein by reference. In accordance with the present invention, the plating apparatus 11 is connected to a vacuum lock system to be described below in which the remaining steps of the process may be carried out in an inert atmosphere and preferably under vacuum. As previously indicated, the plating apparatus is of known construction and need not be described in detail. It suffices to state that the apparatus comprises inlet lock means 12 through which articles or substrates to be processed are to be loaded into the apparatus. Articles which have been plated in accordance with the ion vapor deposition process such as described in the above-mentioned patent, are discharged from the apparatus 11 into output chutes 13 which are connected through valves 14 to a lock hopper 15 wherein the vacuum and inert atmosphere of the plating apparatus 11 is maintained. As indicated in the above cited patent, any suitable sources for vacuum and an inert gas may be provided and these sources and the lines connecting them to, not only the plating apparatus 11, but also other portions of the system need not be shown.

The vacuum lock hopper 15 is connected through a valve 16 to a second canister 21 into which the plated articles are discharged upon prope sequential operation of the lock valves 14 and 16. The canister 21 is also connected to the aforementioned sources of vacuum and inert gas by suitable conduits and valves, not shown, so that the atmosphere maintained therein corresponds to that in the plating apparatus 11. In this embodiment, a primer material from a suitable source of supply, not shown, is adapted to be injected into the canister 21 through valve 31 for initially coating the plated articles. This primer material is such that it will chemically bond with the aluminum or other plating material. Since, as indicated, the articles are maintained in an inert atmosphere under reduced pressure or vacuum in the canister 21, the surface of the aluminum plating remains unoxidized as it was in the plating apparatus and in a condition for rapid and effective chemical bonding with the primer material. In the event sufficient free hydrogen is generated during the chemical bonding step within the canister 21, the canister may be vented through valve 33 so that the hydrogen may be safely disposed of.

After the application of the primer has been completed, the articles are discharged from the canister 21 through valve 35 to canister 22. Frequently an excess of primer material is applied to the substrate in the canister 21 and any such excess is removed within the canister 22 by vacuum drying means and/or vacuum washing means. Thus the canister 22 is connected with a suitable source of vacuum through valve 37. The canister 22 may also be connected with a source of inert gas, not shown, so that the plated and primed articles or substrates may be maintained in an inert atmosphere if desired. Upon completion of the drying operation, the articles are discharged through valve 39 to another canister 23 for the application of the final coating material contemplated in this embodiment. A polymer coating material chemically bondable to the primer is supplied from a source not shown through valve 32 into the canister 23 for completely coating the articles. The canister 23 is preferably connected with a source of vacuum through valve 41 so that the canister is maintained under a vacuum. As will be discussed more below, the plating material applied by the ion vapor deposition process contains numerous voids and by maintaining the articles under reduced pressure or vacuum, the polymer coating material as well as the primer is adapted to enter and effectively fill such voids.

Another canister or other apparatus 24 is positioned for receiving the polymer coated and impregnated substrates from the canister 23 through valve 43. The apparatus or canister 24 may be adapted to apply a suitable catalyst, or ultraviolet light or heat to the articles for promoting chemical bonding of the polymer to the primer and final curing of the polymer. If desired, the canister 24 can also be maintained under a vacuum and with an inert atmosphere. Upon completion of the process, the articles are discharged through valve 45 to any suitable location.

Referring now to FIG. 2, there is seen another embodiment of an apparatus incorporating features of the present invention. In this embodiment, elements corresponding to those described above are designated by the same reference numerals with the suffix a added. The process to be carried out in the apparatus of FIG. 2 differs in that the coating material is comprised of an epoxy or the like which chemically bonds with the aluminum or other plating material without a primer. Hence, the canister 21 shown in FIG. 1 is no longer needed for primer application. In addition, the drying canister of FIG. 1 is relocated as canister **22*a* between the epoxy applying canister 23*a* and the curing canister 24*a* so as to provide vacuum means for spinning off or otherwise removing any excess epoxy which may be applied to the articles in canister 23*a***.

Figures 3, 4, 5:
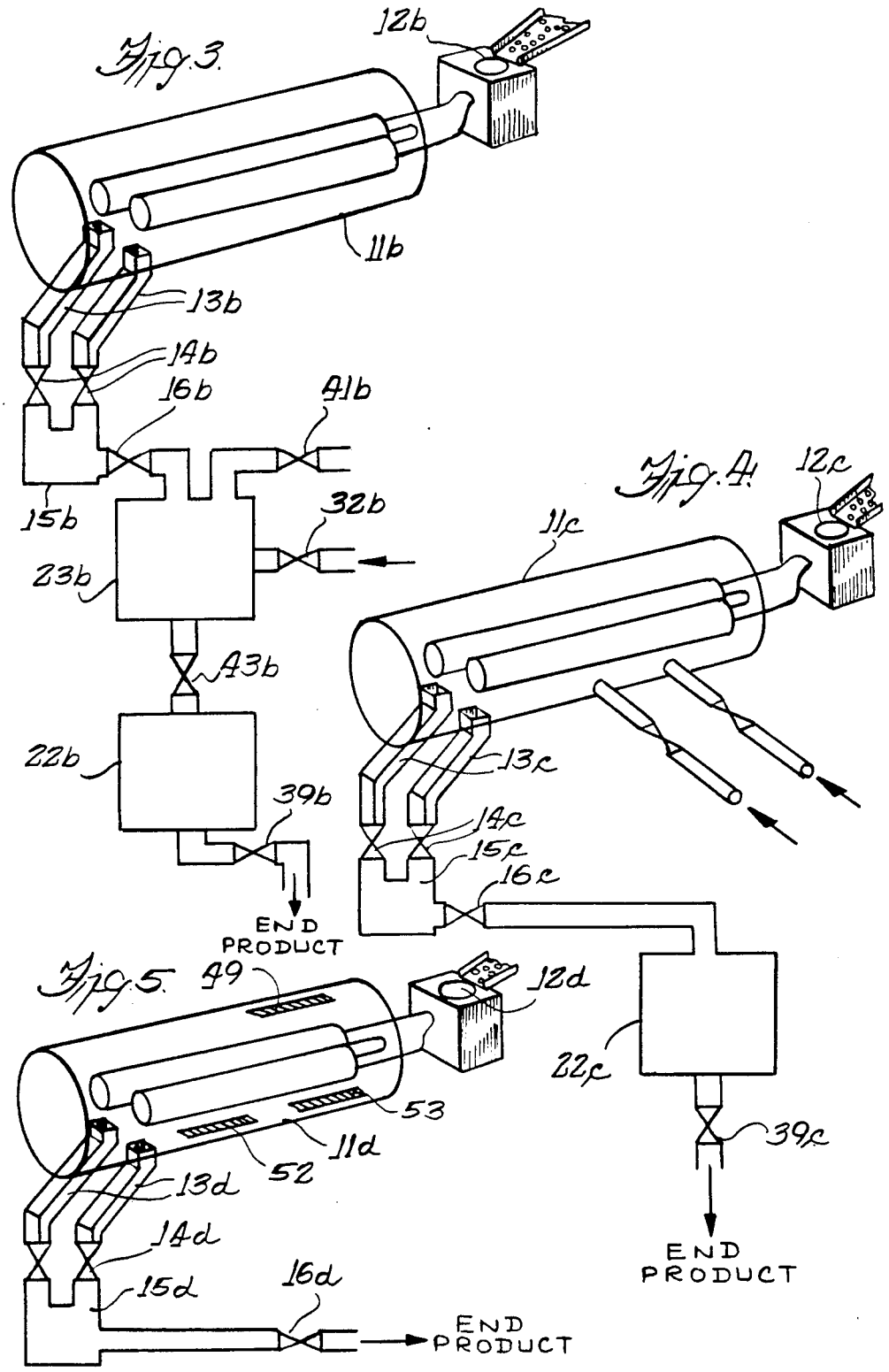
FIG. 3 is a schematic representation of an embodiment of the apparatus of the invention to coat a substrate with non-oxidized plating material, followed by a coating material comprised of stearic acid.
FIG. 4 is a schematic representation of an embodiment of the apparatus of the invention to coat a substrate with non-oxidized plating material, followed by a coating material comprised of boron trifluoride and a polymer.
FIG. 5 is a schematic representation of an embodiment of the apparatus of the invention to coat a substrate with non-oxidized plating material, followed by a coating material comprised of calcium, silicon and oxygen.

Referring now to FIG. 3, there is seen another embodiment of the apparatus which is similar to that described above as indicated by the application of the same reference numerals with the suffix b added to corresponding parts. In this embodiment, the coating material to be applied comprises stearic acid. After the substrate has been coated with non-oxidized plating material in the ion vapor deposition device **11*b*, the substrate is transferred into canister 23*b* and a solution of stearic acid in a suitable solvent is injected through valve 32*b* into the canister 23*b*. The solution contacts the plated substrate and the stearic acid chemically bonds with the plating material. After chemical bonding, the substrate is transferred from the canister 23*b* to canister 22*b*** in which any unreacted reagents are removed by solvent washing and vacuum drying means.

Referring now to FIG. 4, another embodiment of the apparatus is shown in which parts corresponding to those described above are designated by the same reference numerals with the suffix c added. Here, the coating material comprises boron trifluoride and a polymer. The boron trifluoride is supplied from a suitable source, not shown, and is injected through valve 34 directly into the ion vapor deposition chamber **11*c* after the substrate has been coated or plated with non-oxidized aluminum or other plating material. Under the plasma condition which exists in the device 11*c*, the boron trifluoride chemically bonds with the non-oxidized plating material. Means, not shown, is provided for supplying a monomer which may be injected into the device 11*c* through valve 47. The monomer and resulting polymer vacuum impregnate the boron trifluoride-prepared plating material by glow discharge polymerization means. Afterwards, the coated substrate is transferred from the device 11*c* through the vacuum lock means 15*c* to canister 22*c*** wherein unreacted reagents are to be removed by vacuum drying.

Referring now to FIG. 5, there is seen still another modification of the apparatus wherein elements corresponding to those described above are indicated by the same reference numerals with the suffix d added. In this form of the invention, the coating material to be applied is comprised of calcium, silicon and oxygen. Separate boats or containers for the calcium and silicon ar provided and are adapted to be placed separately into the deposition chamber **11*d* after the plating operation has been completed. The apparatus includes means for providing a controlled plasma atmosphere containing oxygen within the chamber 11*d* and an electron beam heater 49 is included for vaporizing the calcium and the silicon. In operation, the calcium, silicon and oxygen which may be introduced into the chamber 11*d*** from a suitable source, not shown, combine to chemically bond with the non oxidized plating material to form a hard silicate coating.

EXAMPLES

The following examples serve to illustrate variations of the method of the present invention which may be carried out with the previously described apparatus and are not intended to limit the scope of the invention.

EXAMPLE 1

An apparatus of the type shown in FIG. 1 may be used to coat steel screws. First, about one mil (0.001 inch) of non-oxidized aluminum should be deposited on the screws within the chamber 11 in accordance with known ion vapor deposition techniques such for example as disclosed in the previously mentioned U.S. Pat. No. 4,116,161. Then discharge the screws from the chamber 11 into canister 21 into which a primer consisting of acrylic acid should be injected for coating the plated screws. The acrylic acid readily provides a good chemical bond with the non-oxidized aluminum plating material. A methoxyphenol inhibitor dissolved in the acrylic acid prevents premature polymerization. Then discharge the screws from the canister 21 into canister 22 in which any unreacted reagents are to be removed by vacuum drying. The screws are then to be transferred to canister 23 wherein Celanese Celrad 3700 and the dilutents hexamethylene diacrylate and/or tripropyleneglycol diacrylate are to be added. Then discharge the screws to canister 24 wherein chemical and/or ultraviolet curing is to be carried out.

EXAMPLE 2

First apply non-oxidized aluminum plating material to steel screws as set forth in Example 1. Then transfer the plated screws to canister 21 in which a primer consisting of glycine and water or para-aminobenzoic acid in ethyl acetate is to be injected for coating the plated articles. Then unreacted reagents are to be removed by washing with water and any residual water is to be removed by vacuum evaporation in the canister 22. Subsequently, the articles are transferred and a polymer material comprising a polyurethane prepolymer, containing isocyanate end groups, is to be applied to the articles in canister 23. Then discharge the screws to the canister 24 wherein curing may be carried out by using the catalyst tin octoate.

EXAMPLE 3

Steel screws are first plated with non-oxidized aluminum as described in the previous examples and by utilizing apparatus shown schematically in FIG. 2. Then the plated screws are discharged into canister 23a wherein a vacuum of $1\times10^{-3}$ mmHg is maintained. Celanese Celrad 3800 diluted with hexamethylene diacrylate and/or tripropyleneglycol diacrylate is next injected into the canister 23a for coating the screws. Then discharge the screws from canister 23a to canister 22a wherein any excess epoxy is to be spun off. The screws are then transferred to canister 24a wherein ultraviolet light or chemical curing may be carried out by using benzoyl peroxide at a temperature of 60°-80° C.

EXAMPLE 4

Plating of screws is first accomplished as in the preceding examples by means of apparatus as disclosed in FIG. 3. Then discharge the screws into canister 23b wherein a vacuum of $1\times10^{-3}$ mmHg is maintained. Subsequently inject a coating material consisting of a solution of stearic acid and solvent into canister 23b and thus coat the plated screws and chemically bond the coating material to the aluminum. Then the screws are to be discharged from canister 23b into canister 22b wherein any unreacted reagents are to be removed by solvent washing and vacuum drying.

EXAMPLE 5

It is proposed that again the screws be plated as before using an apparatus of the type shown schematically in FIG. 4. Then inject a solution of boron trifluoride into the ion vapor deposition chamber 11c through valve 34 and thereafter inject tetrafluoroethylene into the chamber 11c for coating the boron trifluoride prepared aluminum plated screws. The screws should then be discharged from the chamber 11c into canister 22c wherein unreacted reagents are to be removed by vacuum drying.

EXAMPLE 6

An apparatus of the type shown in FIG. 5 may be used to coat steel screws with non-oxidized aluminum plating material as described above in the previous examples. Then place calcium and silicon in separate boats or containers 51 and 53 in the chamber 11d whereupon a controlled plasma atmosphere containing oxygen is provided. The electron beam heater 49 is used to vaporize the calcium and silicon which combine to form a silicate coating chemically bonded to the aluminum plating material on the screws. The coated screws may then be removed from the deposition chamber 11d and conveyed to a suitable point of discharge.

Figure 7:
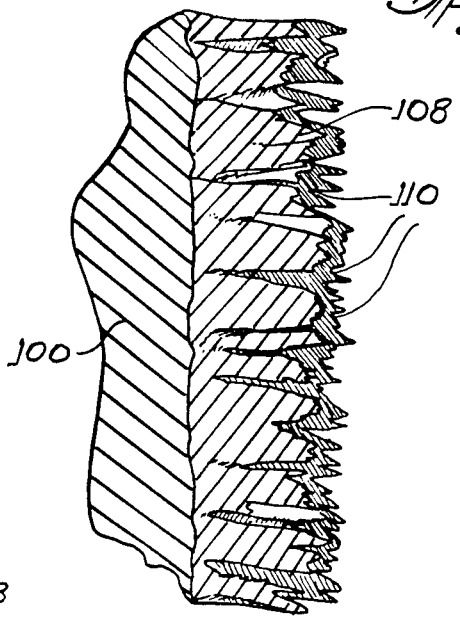
FIG. 7 is an enlarged partially cut away view of a substrate surface, after plating material has been deposited on the substrate via ion vapor deposition.
Figure 8:
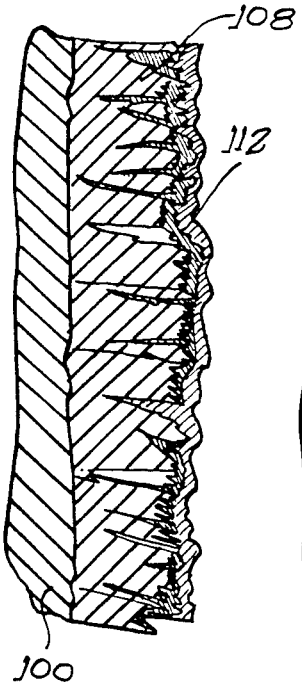
FIG. 8 is an enlarged partially cut away view of a plated substrate after a primer has chemically bonded with the plating material.

FIGS. 6 through 10 show articles or substrates produced in accordance with methods of the present invention described above. As an example of only one article which may be produced in accordance with the present invention, FIG. 6 shows a screw 100 having a conventional head 102 and a conventional threaded shank 104. The screw is formed from steel and has a surface 106 provided by plating and coating material as described above. In FIG. 7 there is shown in greatly enlarged and fragmentary sectional form a portion of the screw after the initial step of plating by means of ion vapor deposition. More specifically, the screw or substrate 100 has its surface plated or coated by a layer of aluminum 108. It is noted that while the aluminum applied in this manner effectively substantially completely coats the substrate, it is nevertheless applied so that a somewhat columnar (at least when viewed under an electron microscope) structure results which includes a number of voids 110. When the screws in the plated condition of FIG. 7 are processed in accordance with the method of Examples 1 and 2 above, a coating of primer material 112 is applied and chemically bonds with the surface of the non-oxidized aluminum plating. Then a coating 114 of the polymer material is applied and chemically bonds with the primer. As previously indicated, the coating steps of the process are carried out under vacuum conditions which facilitate entry of the primer and then the polymer materials into the voids 110 so as to insure filling of these voids and the provision of a continuous coating over the plated screw.

Figure 9:
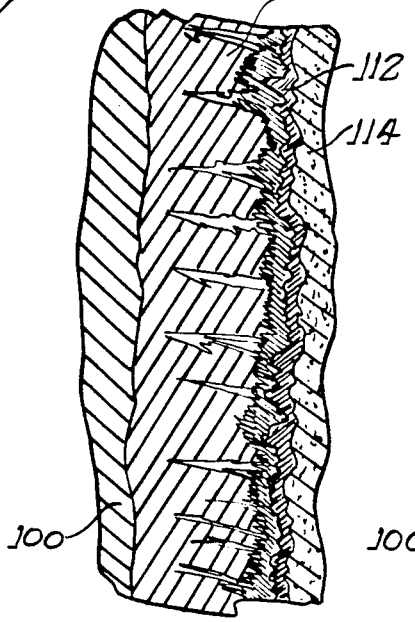
FIG. 9 is an enlarged partially cut away view of a primer-prepared substrate after a polymer has chemically bonded with the primer.
Figure 10:
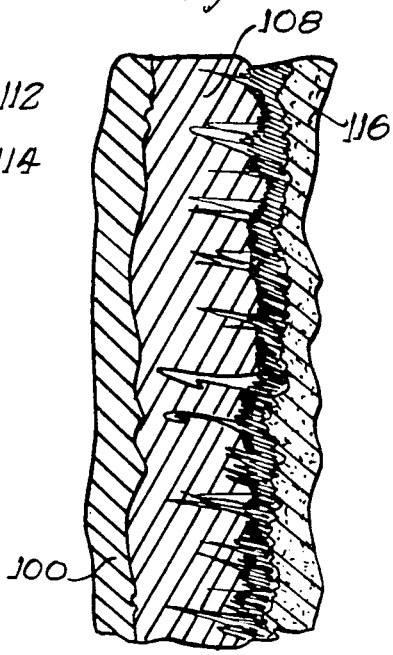
FIG. 10 is an enlarged partially cut away view of a substrate, coated with a plating material and a polymer only.

FIG. 10 is a view similar to that of FIG. 9 but shows a screw structure which incorporates a coating material 116 of the type applied in the embodiments of Examples 3 and 4 which do not utilize a primer. In this form of the invention, the coating material or polymer is of a type capable of chemically bonding directly with the non-oxidized aluminum plating material.

The invention is claimed as follows:

1. An apparatus for producing a coated article comprising a first vacuum chamber for applying a layer of non-oxidized metal plating material to the article while maintaining the plated article in an atmosphere preventing oxidation of the plating material and a second vacuum chamber adjacent said first vacuum chamber for applying a layer of a coating material in liquid form to said plating material while maintaining the plated articles in an inert atmosphere, and means for preventing said coating material from entering said first vacuum chamber.

2. An apparatus, as defined in claim 1, wherein said first vacuum chamber comprises vacuum ion vapor deposition means, said second vacuum chamber maintaining said articles under a vacuum and in an inert atmosphere and separate from said first chamber until the coating material has been applied and chemically bonded to the plating material.

3. An apparatus, as defined in claim 2, which includes means for applying a primer material chemically bondable with the plating material to the articles in said vacuum means, a third vacuum chamber for receiving articles from said second vacuum chamber, and means for applying a polymer coating material to primed articles in said third vacuum chamber.

4. An apparatus, as defined in claim 3, which includes means between said second and third mentioned vacuum chambers for removing any excess primer from the articles.

5. An apparatus, as defined in claim 3, which includes means for receiving articles from said third vacuum chamber and for curing the polymer coating material applied to the articles.

* * * * *